United States Patent [19]

Thierstein

[11] Patent Number: 4,528,794

[45] Date of Patent: Jul. 16, 1985

[54] APPARATUS FOR TEMPORARY STORAGE OF PAPER SHEETS

[75] Inventor: Hans Thierstein, Wiler, Switzerland

[73] Assignee: Grapha-Holding Aktiengesellschaft, Hergiswil, Switzerland

[21] Appl. No.: 498,959

[22] Filed: May 27, 1983

[30] Foreign Application Priority Data

Jun. 14, 1982 [CH] Switzerland ..... 3661/82

[51] Int. Cl.[3] ..... B65B 63/04

[52] U.S. Cl. ..... 53/118; 53/587; 53/591; 53/593; 242/59; 271/213; 414/29

[58] Field of Search ..... 53/430, 118, 593, 587, 53/556, 441, 211, 212, 214, 591; 414/29, 32, 57, 68; 242/59, 67.2, 67.3 R, 67.4, 55, DIG. 2; 270/52, 54, 56, 52.5; 226/76; 271/151, 202, 216, 203

[56] References Cited

U.S. PATENT DOCUMENTS

| | | | |
|---|---|---|---|
| 3,360,209 | 12/1967 | Rochi | 242/58 |
| 3,749,330 | 7/1973 | Gazzola et al. | 242/67.3 R |
| 3,775,223 | 11/1973 | Moseley et al. | 242/59 X |
| 4,238,261 | 12/1980 | Tetro | 242/59 X |
| 4,431,140 | 2/1984 | Tetro | 242/58 X |
| 4,434,948 | 3/1984 | Feldkämper | 242/59 |
| 4,438,618 | 3/1984 | Honegger | 53/118 X |

*Primary Examiner*—Horace M. Culver
*Attorney, Agent, or Firm*—Peter K. Kontler

[57] ABSTRACT

Apparatus for temporary storage of successive portions of a continuous stream of paper sheets has a transporting unit which advances the stream along a horizontal path, a frame which defines for successive rotary cores an elongated guideway above the path, a two-armed lever which can support a fresh reel containing a supply of wound flexible band material at a level below the path, and chains which can transport successive cores from the inlet portion to the outlet portion of the guideway in parallelism with the path. The lever is indexible through 180 degrees and carries two spindles each of which can support a reel. The leader of the band on a reel on one of the spindles is attached to an empty core in the inlet portion of the guideway while a pawl intercepts the foremost sheets of the stream in the path and while the empty core is rotated by the belts of the transporting unit. The pawl is then retracted, and the sheets of the advancing stream are stored between the convolutions of the band which is wound onto the core. The core is transported to the outlet portion of the guideway while the supply of convoluted band and stored sheets thereon grows.

30 Claims, 2 Drawing Figures

II
II
M

APPARATUS FOR TEMPORARY STORAGE OF PAPER SHEETS

BACKGROUND OF THE INVENTION

The present invention relates to apparatus for temporarily storing successive sheets of a stream of partly overlapping or non-overlapping sheets. More particularly, the invention relates to improvements in apparatus of the type wherein the sheets are confined between the convolutions of a band which is wound onto a core. Still more particularly, the invention relates to improvements in apparatus of the type wherein the sheets are supplied to the upper side of a band which is drawn from a reel and wherein the reel is disposed at a level below whereas the core is located at a level above the path for the sheets.

A drawback of conventional apparatus of the above outlined character is that the delivery of sheets must be interrupted for relatively long intervals of time whenever a core and the corresponding band are converted into a fully grown roll. This can present serious problems when the nature of the source of sheets is such that the sheets must be accepted without interruptions or, at the very least, that the interruptions be short or extremely short. Such situation can develop when the sheets issue from a printing machine and are fed to a sheet folding unit which discharges a continuous stream of partly overlapping or non-overlapping folded sheets. If the apparatus which is designed to convert the continuous stream of sheets into a succession of shorter streams, each of which is temporarily stored between the convolutions of a band, requires relatively long intervals of non-delivery of sheets between the completion of a roll and the start of confinement of sheets on the core of the next roll, the printing machine and the folded unit must be arrested with attendant considerable losses in output.

OBJECTS AND SUMMARY OF THE INVENTION

An object of the invention is to provide an apparatus wherein successive portions of a continuous stream of partly overlapping or non-overlapping sheets (e.g., paper sheets) can be introduced into temporary storage facilities practically without any intervals between completed storage of a preceding portion and start of storage of the next-following portion of the continuous stream.

Another object of the invention is to provide an apparatus of the above outlined character which is constructed and assembled in such a way that successive portions of a continuous stream of sheets can be stored on the cores of successive rolls without necessitating even short-lasting stoppage of the machine or machines which supply the sheets.

A further object of the invention is to provide an apparatus wherein fresh cores of rolls and fresh reels of flexible band material can be held in positions of readiness prior to completion of storage of sheets on a growing roll.

An additional object of the invention is to provide the apparatus with novel and improved means for supporting, guiding and otherwise manipulating the cores of successive rolls which store portions of a continuous stream of paper sheets or the like.

Still another object of the invention is to provide a novel and improved method of temporarily storing successive portions of a continuous stream of paper sheets or the like between the convolutions of successive bands which are wound onto successive cores to form therewith rolls wherein the convolutions of the bands confine and hold the stored sheets against movement with reference to one another.

An additional object of the invention is to provide an apparatus which can be utilized with advantage for temporary storage of successive portions of a continuous stream of paper sheets which are on their way from a printing machine to a gathering or like processing machine.

Another object of the invention is to provide the apparatus with novel and improved means for supporting and otherwise manipulating successive reels of bands which are to be connected to and convoluted around discrete cores to form therewith rolls which store discrete portions of a continuous stream of paper sheets or the like.

The apparatus of the present invention serves to store successive sheets of a stream of partly overlapping or non-overlapping sheets and comprises means for transporting the sheets of the stream in a predetermined direction and along an elongated path (e.g., along a straight or substantially straight horizontal path), guide means disposed at a level above the path and including an inlet portion and an outlet portion for a plurality of rotary cores which are insertable seriatim at required intervals into the inlet portion of the guide means, means for rotating the core which is inserted into the guide means, and a support which is disposed below the path and can carry at least one of a plurality of reels each of which is arranged to be separably mounted on the support when the need for a fresh reel arises and each of which includes a rotary hub and a supply of elongated flexible (preferably elastic) band which is wound around the respective hub and includes a leader connectable to the core which is inserted into the inlet portion of the guide means so that the band extends across the path and receives sheets from the transporting means when the core in the guide means is rotated in a direction to draw the band off the hub of the reel on the support and to convolute the band therearound with attendant confinement of sheets between the convolutions of the band on the core in the guide means and gradual increase of the diameter of the growing roll including the core in the guide means, the convolutions of the band on such core and the sheets between the convolutions of such band. A roll is fully grown when the entire band of a reel is convoluted around the respective core.

The guide means preferably includes an elongated main or central portion extending in the general direction of transport of sheets along the path. The length of the main portion of the guide means preferably matches or exceeds the radius of an empty core plus the radius of a fully grown roll. This renders it possible to insert an empty core into the inlet portion of the guide means while the core of a fully grown roll is still located in the outlet portion of the guide means.

The apparatus preferably further comprises a frame or housing which supports or includes the guide means and which preferably comprises one or more downwardly sloping ramps or other suitable means for directing successive empty cores into the inlet portion of the guide means. The outlet portion of the guide means preferably includes or is adjacent to a suitably configurated mouth or analogous means for facilitating removal of the cores of fully grown rolls from the outlet portion of the guide means. Such outlet portion is located downstream of the inlet portion, as considered in the direction of transport of sheets along the path.

The support includes means for moving the hub of a reel thereon between first and second positions which are spaced apart from one another by a distance at least matching the radius of an intact reel plus the radius of a hub. This renders it possible to mount on the support a fresh or intact reel prior to removal of the hub of a spent reel i.e., the support can simultaneously carry a fresh reel and the hub of a spent reel. The hub which occupies the second position is located downstream of the hub which occupies the first position, as considered in the direction of transport of sheets along the path. The main portion of the guide means is or can be at least substantially parallel to the adjacent portion of the path.

The apparatus can further comprise a pivotable pawl or an analogous intercepting device which is installed in or on the frame upstream of the guide means, and a motor or other suitable means for moving the intercepting device to and from an operative position in which the intercepting device extends into the path and intercepts the oncoming sheets of the stream to thus establish in the path a gap between the non-intercepted preceding (stored) portion of the stream and the intercepted sheets. Such gap is desirable in order to allow for advancement of the leader of the band of a fresh reel on the support through the gap (i.e., across the path of the sheets) preparatory to coupling of the leader to a core which is inserted into the inlet portion of the guide means. Each core preferably includes a stub shaft at each of its ends, and the guide means preferably defines an elongated channel wherein the stub shafts of the cores can move sideways (the channel can include two mirror symmetrical halves, one at each side of the path which is defined by the transporting means, so that each stub shaft of a properly inserted core advances sideways in the respective half of the channel).

The inlet portion of the guide means preferably extends toward and the outlet portion of the guide means preferably extends away from the path. For example, each of these portions can make with the adjacent portion of the path an angle of or close to 90 degrees.

The means for rotating a core which is inserted into the guide means can comprise a motor or another suitable prime mover which drives the transporting means. The inlet portion is then sufficiently close to the path to ensure that a core which is inserted into the inlet portion of the guide means is rotated by the transporting means (e.g., by the upper reaches of endless belts which form part of the transporting means and whose upper reaches advance the sheets along the aforementioned path) whereby the growing roll, which develops when the leader of a band is coupled to such core, moves in the inlet portion upwardly and away from the path and toward the level of the main portion of the guide means. The distance between the lowermost portion of the aforementioned ramp and the path for the sheets at least matches (but preferably exceeds) the radius of a core; this ensures that a core which advances along the ramp is not rotated by the transporting means, i.e., that rotation of the core begins when it enters the inlet portion of the guide means. As mentioned above, the guide means can include a mouth which is adjacent to the discharge end of the outlet portion and is configurated with a view to facilitate removal of fully grown rolls from the guide means.

The apparatus further comprises means for advancing successive cores from the inlet portion, along the main portion and to the outlet portion of the guide means. Since the outlet portion extends away from the path (i.e., upwardly if the path is horizontal or nearly horizontal), the core of the growing roll can move in the outlet portion sideways in a direction away from the path, namely, toward and into the mouth of the guide means. The advancing means can comprise at least one endless chain or an analogous conveying element which is mounted on the frame and has entraining means arranged to advance a properly inserted core from the inlet portion to the outlet portion of the guide means. This provides room for insertion of a fresh core not later than when the roll whose core is located in the outlet portion of the guide means is fully grown.

The support can constitute a two-armed lever which is indexible about a horizontal axis, extending transversely of the path, through angles approximating or equaling 180 degrees. The two arms of such lever constitute the first and second portions of the support and each thereof can carry a spindle for the hub of a reel. These first and second portions switch positions when the lever is indexed through 180 degrees, either by hand or by a suitable motor. The distance between the axes of the two spindles (i.e., between the axes of hubs on such spindles) on the first and second portions of the support preferably equals or exceeds the radius of a hub (spent reel) plus the radius of a fresh or intact reel. The reason for such selection of this distance has been pointed out above, i.e., the operator can place the hub of an intact reel onto one of the spindles not later than when the supply of band on the hub which is carried by the other spindle is exhausted. This allows for the placing of a fresh reel onto the support before the hub of a spent reel is removed. Such apparatus can further comprise means for moving the leader of the band of a fresh reel on one of the spindles across the path of sheets so that the leader of such band can be coupled to the core in the inlet portion of the guide means (of course, such coupling of the leader is preceded by the establishment of the aforediscussed gap between the trailing sheet of the non-intercepted portion of the stream and the sheets held by the intercepting device which then dwells in its operative position and leaves such position as soon as the coupling of the leader of a band to the core in the guide means is completed). Each core and the leader of each band respectively comprise complementary first and second coupling elements for releasably attaching the leader of a band forming part of a fresh reel on a spindle of the support to the core in the inlet portion of the guide means. The coupling element on the leader of a band can comprise or constitute a hook-shaped member, and the coupling element of the core can constitute a recess or socket which is provided in the peripheral surface of the core and can receive the hook-shaped member.

The aforementioned moving means is preferably mounted on the support and preferably includes discrete first and second moving devices, one for each of the two spindles on the support. Each moving device can comprise a flap which is pivotably mounted on the respective portion of the support and a motor which can pivot the flap. The leader of a band is placed onto the adjacent flap before the flap is pivoted in a direction to move the leader across the path of sheets and sufficiently close to a core in the inlet portion of the guide means so that the hook-shaped member automatically enters the recess when the core begins to rotate in response to engagement with the adjacent portion of the transporting means.

The trailing portion of each band can be provided with a first connecting element, and each band preferably further comprises a complementary second connecting element which is disposed at the exterior of the outermost convolution of a fully grown roll and can be releasably engaged by the first connecting element to thus hold the trailing end against movement with reference to the outermost convolution. The two connecting elements can constitute a conventional Velcro (trademark) connection.

The frame can comprise a first section at one side of the guide means and a second section at the opposite side of the guide means. Such apparatus can further comprise means for movably connecting the two sections to each other. One of the sections is movable to and from an operative position, and the guide means has at least one elongated channel which is defined by the two sections of the frame in the operative position of the one section. The apparatus which employs such frame preferably further comprises one or more springs or other suitable means for yieldably biasing the one section to its operative position. The connecting means can include or constitute a pivot member which is adjacent to the inlet portion of the guide means and defines for the one section a preferably horizontal pivot axis which extends transversely of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
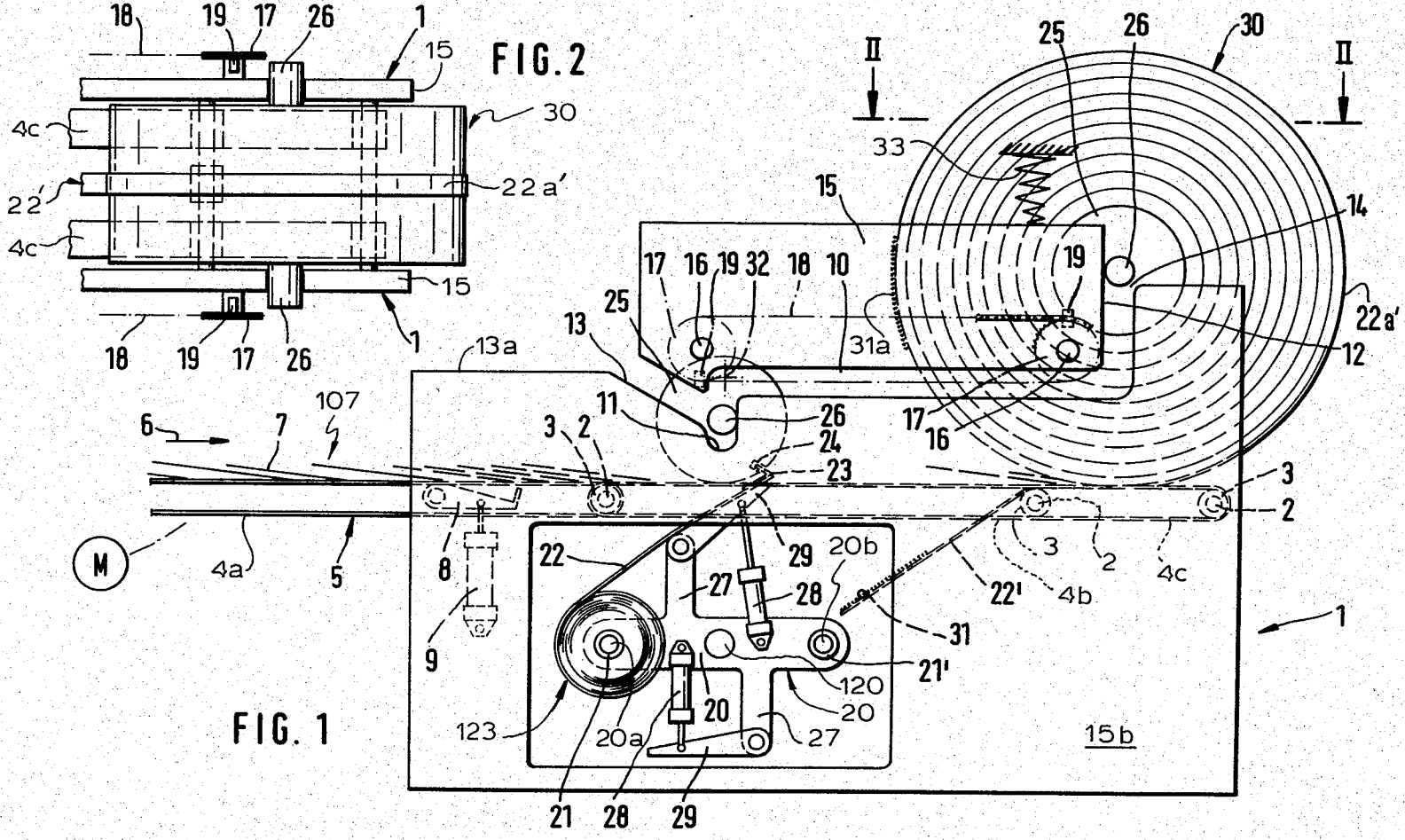
FIG. 1 is a somewhat schematic elevational view of an apparatus which embodies one form of the present invention, a fresh core being located in the inlet portion and a fully grown roll being located in the mouth above the outlet portion of the guide means.
FIG. 2 is a fragmentary plan view as seen in the direction of arrows from the line II—II of FIG. 1.

The apparatus which is shown in the drawing comprises a frame including two spaced apart parallel upright sidewalls or cheeks 1 which are rigidly connected to one another by several distancing elements, not shown. The sidewalls 1 support several parallel horizontal shafts 2 for idler pulleys 3 forming part of a transporting unit 5 which serves to deliver a scalloped stream 107 of partially overlapping paper sheets 7. The direction in which the stream 107 is advanced from a suitable source, not shown, is indicated by the arrow 6. The transporting unit 5 further comprises three conveyors in the form of pairs of parallel endless flexible elements which constitute belts or chains (e.g., toothed belts if the elements 3 are toothed pulleys) defining an elongated horizontal or substantially horizontal path for delivery of sheets 7 onto the upper side of an elongated elastic band 22. The belts include a first pair of belts **4*a*, a second pair of belts 4*b* and a third pair of belts 4*c*. As can be seen in FIG. 2 (which shows the belts 4*c*), the clearance between the pairs of belts is sufficiently wide to enable the band 22 or a second band 22' to pass therebetween. Instead of transporting a scalloped stream 107 of partly overlapping sheets 7, the unit 5** can also receive and transport a stream wherein the sheets are disposed end-to-end with relatively wide or relatively narrow clearances between successive sheets.

An intercepting device in the form of a pivotable pawl 8 is installed in the frame in the space between but at a level below the belts **4*a* and is movable by a fluid-operated motor 9 (e.g., a double-acting pneumatic cylinder and piston unit) between the illustrated inoperative or retracted position and a raised or operative position in which its pallet extends into the path of oncoming sheets 7 and temporarily holds such sheets against further advancement with the upper reaches of the belts 4*a* toward the upper reaches of the belts 4*b*. The purpose of the intercepting pawl 8 is to subdivide a continuous scalloped stream 107 into a succession of shorter streams each of which is temporarily stored between the convolutions of discrete flexible bands 22', 22, etc. As shown in FIG. 1, the band 22' already stores a stream of finite length, and the band 22** is about to begin with the storing of the next-following stream of finite length.

The sidewalls 1 carry or define elongated guide means for the stub shafts 26 of a succession of rotary cores 25 which are connectable with the leaders of discrete bands. In the illustrated embodiment, the guide means are actually surfaces bounding two registering horizontal channels or slots 10 which are machined into the sidewalls 1 of the frame. The slots 10 which are bounded by the just mentioned guide surfaces are straight, elongated and at least substantially parallel to the path which is defined by the upper reaches of the belts **4*a*, 4*b* and 4*c*. Each of the two slots 10 has a downwardly extending vertical or nearly vertical inlet portion 11 and an upwardly extending vertical or nearly vertical outlet portion 12 terminating in a mouth 14 which facilitates convenient lifting of the respective stub shaft 26 above and away from the corresponding sidewall 1. The inlet portions 11 can receive stub shafts 26 of a fresh (empty) core 25 from directing means in the form of downwardly sloping ramps 13 defined by portions of edge faces of the respective sidewalls 1. It will be noted that each inlet portion 11 extends from the straight main or central portion of the respective slot 10 and toward the path which is defined by the transporting unit 5, whereas the outlet portions 12 extend upwardly and away from such path. The portions 11 and 12 can extend at right angles to the path for the sheets 7 in the transporting unit 5**.

The upper sections 15 of the sidewalls 1 (namely, the sections above the respective slots 10) carry outwardly extending stub shafts 16 for sprocket wheels 17. An endless conveying device in the form of a chain 18 is trained over the sprocket wheels 17 at the outer side of each of the two upper sections 15. Each chain 18 carries an entraining element or pusher 19 which is outwardly adjacent to the respective slot 10 during travel with the lower reach of the corresponding chain 18. These pushers engage the respective stub shafts 26 when such shafts are lifted to their upper end positions at the levels above the respective inlet portions 11. The chains 18 are then set in motion to cause the respective pushers 19 to advance the adjacent stub shafts 26 into the lowermost parts of the outlet portions 12. Such lowermost parts are sufficiently wide to allow the projections 19 to bypass the respective stub shafts 26 and to move back to their starting positions below the left-hand shafts 16.

The frame including the sidewalls 1 further supports the horizontal shaft 120 of a support here shown as a two-armed lever 20 whose arm-like portions respectively carry horizontal spindles 20*a*, 20*b* for discrete hubs 21 and 21'. The hub 21 forms part of a reel 123 which includes the flexible band 22; such band is wound onto the hub 21 and is about to be convoluted onto the core 25 whose stub shafts 26 extend into the inlet portions 11 of the slots 10. The lever 20 is indexible at intervals through angles of approximately or exactly 180 degrees, either by hand or by resort to a suitable prime mover, not shown. The leader of the band 22 is provided with a hook-shaped coupling element 23 which removably extends into a complementary coupling element here shown as a recess or socket 24 provided in the periphery of the core 25 between the belts 4*b* of the transporting unit 5. The hub 21' is empty because the trailing end of the respective band 22' has been fully disconnected therefrom. To this end, the peripheral surface of the hub 21' is provided with one component or connecting element of a Velcro (trademark) connection and the other component or element (31) of such connection is provided at one side of the trailing end of the band 22'. The manner in which the trailing end of the band 22 is separably connected to the hub 21 of the reel 123 is preferably the same. An additional connecting element or component 31*a* of a Velcro (trademark) connection is provided at the outer side of the outermost convolution 22*a'* of the band 22' on the core 25 of the fully grown roll 30 shown in the right-hand portion of FIG. 1. The component or connecting element 31*a* is engaged by the component or connecting element 31 in response to further counterclockwise rotation of the fully grown roll 30 so that the trailing end of the band 22' cannot flap around during storage of the roll 30 or during transfer of such roll to a machine (e.g., a gathering machine) wherein the roll 30 is relieved of stored sheets 7 by being rotated in a direction to pay out the band 22'.

The support or lever 20 is formed with two lateral projections or fingers 27 which extend sideways from the respective arms and to the opposite sides of the lever 20. The outer end portions of the fingers 27 carry flaps 29 which can be pivoted by discrete fluid-operated motors 28, e.g., motors in the form of double-acting pneumatic cylinder and piston units whose cylinders are articulately connected to the respective arms of the lever 20 and whose piston rods are articulately connected to the respective flaps 29. The leader of the band 22 is placed onto the adjacent flap 29 while the respective motor 28 maintains its piston rod in retracted position so that the hook-shaped coupling element 23 on the leader of the band 22 is disposed at a level below the path portion which is defined by the upper reaches of the belts 4*b*. When the pawl 8 is pivoted to its operative position to intercept the foremost sheet 7 of the next-following stream of finite length, the left-hand motor 28 is caused to extend its piston rod so that the coupling element 23 of the band 22 is moved to the illustrated position and can enter the recess 24 of the core 25, whose stub shafts 26 extend into the inlet portions 11 of the slots 10, as soon as the core 25 is set in rotary motion. Once the coupling element 23 enters the recess 24 and the core 25 continues to rotate (in a counterclockwise direction, as viewed in FIG. 1), the reel 123 automatically pays out the band 22 and such band is caused to form a succession of convolutions around the peripheral surface of the core 25. The left-hand flap 29 can be lowered (e.g., into a substantially horizontal plane) as soon as the core 25 begins to draw the band 22 off the reel 123 on the left-hand arm of the lever 20. Each flap 29 and the associated motor 28 can be said to constitute a discrete moving device which can move the leader of a band across the path of sheets 7 on the transporting unit 5 so that the coupling element 23 of such leader can be removably attached to the core 25 whose shafts 26 are received in the inlet portions 11 of the slots or channels 10.

The length of the main or central portion of each slot 10 preferably equals or exceeds the radius of a core 25 plus the radius of a fully grown roll 30. The distance between the axes of the spindles 20*a* and 20*b* preferably at least equals or exceeds the radius of an intact reel 123 plus the radius of a hub 21 or 21'. The distance between the lowermost portions of the ramps 11 and the upper reaches of the belts 4*b* therebelow equals or exceeds the radius of a core 25; this ensures that a core 25 can be driven by the belts 4*b* as soon as its shafts 26 enter the respective inlet portions 11.

The motor M which drives the belts 4*a*, 4*b*, 4*c* constitutes the means for rotating the core 25 whose shafts 26 are received in the respective slots 10.

The operation is as follows:

The core 25 is inserted into the apparatus by placing its stub shafts 26 onto the respective ramps 13 so that the shafts 26 roll into the inlet portions 11 of the respective slots 10. The peripheral surface of the core 25 is then sufficiently close to the upper reaches of the belts 4*b* to be set in rotary motion, i.e., the core 25 begins to rotate in a counterclockwise direction, as viewed in FIG. 1. as soon as the stub shafts 26 enter the respective inlet portions 11. The flap 29 on the left-hand finger 27 of the lever 20 is pivoted to the illustrated position while the pawl 8 intercepts the oncoming sheets 7 whereby the hook-shaped coupling element 23 on the leader of the band 22 enters the recess 24 and the reel 123 begins to pay out the band 22. The intercepting pawl 8 is retracted by its motor 9 and the upper flap 29 of FIG. 1 is retracted by its motor 28. The upper reaches of the belts 4*b* deliver successive sheets 7 onto the upper side of the band 22 in the region where the path of the band 22 crosses the path which is defined by the upper reaches of the belts 4*b* whereby the band 22 advances the sheets 7 and confines them between the convolutions which are formed on and surround the rotating core 25. As the diameter of the growing roll, including the core 25 and the convolutions of the band 22 therearound grows, the stub shafts 26 gradually rise in the inlet portions 11 of the respective slots 10. This moves the stub shafts 26 into the range of the pushers 19 on the respective chains 18. The motor (not shown) for the chains 18 is set in motion (e.g., in response to a signal which is generated by a device serving to monitor the level of one of the stub shafts 26 or the diameter of the growing roll including the core 25) at the instant when the stub shafts 26 rise to a level such that they can move along the horizontal main or central portions of the respective slots 10 toward the respective outlet portions 12. The pushers 19 entrain the stub shafts 26 from the upper ends of the inlet portion 11 to the lower ends of the outlet portions 12 where the projections 16 and the projections 19 are free to bypass the respective stub shafts 26 and the stub shafts 26 can begin to rise to progressively higher levels in response to growing diameter of the roll including the core 25.

The signal which is used to set the chains 18 in motion (in a direction to move their lower reaches from the left to the right, as viewed in FIG. 1) can also be used to initiate indexing of the lever 20 through 180 degrees (but the lever 20 can also be indexed subsequent to starting of the motor for the chains 18) so that the hubs 21 and 21' change positions, i.e., the expiring reel 123 is moved nearer to the outlet portions 12 of the slots 10. The surfaces bounding the outlet portions 12 of the slots 10 guide the stub shafts 26 of the core 25 forming part of the growing roll during upward movement toward the respective mouths 14.

As mentioned above, the trailing end of the band 22 is connected to the hub 21 by a Velcro (trademark) connection or an analogous connection so that the trailing end of the band 22 can be detached from the hub 21 when the band 22 is fully paid out. The element or component 31 of the connection at the trailing end of the band 22 then engages the component 31*a* of the connection at the outer side of the outermost convolution of the band 22 on the core 25, the same as described above in connection with the components 31, 31*a* on the band 22'. When the convoluting of the band 22 onto the core 25 is completed, the diameter of the roll including the core 25 matches that of the roll 30 which is shown in the right-hand portion of FIG. 1. Once the components 31, 31*a* on the trailing portion of the band 22 and on the outermost convolution of this band on the core 25 adhere to each other to prevent uncontrolled escape of freshly stored sheets 7, the fully grown roll including the core 25, the band 22 and the sheets 7 between the convolutions of the band 22 is ready to be lifted off the frame, i.e., the stub shafts 26 are lifted out of the respective mouths 14 at the upper ends of the corresponding outlet portions 12. The removed roll can be put into storage or is delivered to a gathering machine or the like, i.e., to a machine which can consume or process the sheets 7 subsequent to temporary storage of such sheets between the convolutions of the band 22.

The operator can slip the hub 21 of a fresh reel 123 onto the spindle 20*b* (which then occupies the position of the spindle 20*a* shown in FIG. 1) while the diameter of the roll including the core 25 grows, i.e., while the stub shafts 26 rise in the corresponding outlet portions 12. The leader of the band of such fresh reel is placed onto the corresponding flap 29 of the lever 20. One or more fresh cores 25 can be moved to positions of readiness in which their stub shafts 26 rest on the platforms 13*a* preceding the ramps 13 of the respective sidewalls 1. When the winding of the band 22 upon the core 25 is terminated, a suitable monitoring device can detect the diameter of the fully grown roll or the positions of the stub shafts 26 and starts the motor 9 which pivots the intercepting pawl 8 to the operative position so that the pawl 8 prevents the sheets 7 from advancing onto the belts 4*b* before the fresh core is caused to assume the position occupied in FIG. 1 by the core 25 and before the corresponding flap 29 is pivoted upwardly to move the hook-shaped coupling element 23 on the leader of the reel which is supported by the spindle 20*b* so that the coupling element 23 can enter the recess 24 of the core whose stub shafts are received in the inlet portion 11, i.e., of the core which is already rotated by the belts 4*b*. The procedure is then repeated in the aforedescribed manner. The flap 29 can be pivoted upwardly immediately after the intercepting pawl 8 assumes its operative position because such movement of the pawl causes the development of a gap between the rear end of the stream portion which is confined between the convolutions of the band 22 and the forward end of the next portion of the stream 107.

The upper sections 15 of the sidewalls 1 are pivotably connected to the respective stationary lower sections 15*b* by one or more horizontal pivot members 32 which are adjacent to the inlet portions 11 of the slots 10. The two sections 15 can be said to constitute a composite upper section at the upper sides and the two sections 15*b* can be said to constitute a composite lower section which is disposed at the undersides of the slots 10. One or more springs (one is shown schematically at 33) are preferably provided to yieldably bias the composite upper section of the frame to the illustrated operative position in which the width of the main portion of each slot 10 is at least substantially constant. Such construction of the frame ensures that the diameter of the growing roll including the core 25 can increase while the shafts 26 of such core move sideways in the main portions of the respective slots 10 because the spring or springs 33 then yield and enable the composite upper section to pivot about the axis of the pivot member or members 32 in a counterclockwise direction so as to increase the width of the main portions of the slots 10 in directions from the respective inlet portions 11 toward the respective outlet portions 12. The composite upper section including the sections 15 is pivoted by the stub shafts 26 of the core 25 which advances from the inlet portions 11 toward the outlet portions 12 under the action of adjacent entraining elements 19 on the chains 18.

It is further possible to provide discrete prime mover means for rotating the core 25 which is introduced into the inlet portions 11 of the slots 10. The illustrated rotating means (motor M) is preferred in many instances because the provision of a discrete motor and of torque transmitting means from such motor to a core 25 in the guide means including the slots 10 would contribute to complexity of the apparatus. Moreover, the belts 4*b* of the transporting unit 5 can rotate the core 25 in the guide including the slots 10 at a requisite peripheral speed so that the core draws the band 22 off the reel 123 at the rate which corresponds to the rate of delivery of sheets 7 onto the upper side of that portion of the band 22 which extends across the path of sheets 7 on the upper reaches of the belts 4*b*.

An advantage of the improved apparatus is that the length of intervals during which the intercepting pawl 8 prevents the sheets 7 from advancing along their path is very short so that the machine or machines which supply the sheets 7 to the transporting unit 5 need not be arrested while the pawl 8 is held in the operative position. This is due to the fact that one or more cores 25 can be held in positions of readiness adjacent to the inlet portions 11 of the slots 10 and that an intact reel 123 can be mounted on one of the spindles 20*a*, 20*b* on the support 20 before the supply of band on the reel which is mounted on the other spindle is exhausted. Also, the leader of a band can be automatically coupled to the core 25 which is inserted into the inlet portions 11 of the slots 10, and the chains 17 ensure automatic advancement of a growing roll from the inlet portions 11 to the outlet portions 12 of the slots 10 to thus provide room for insertion of a fresh (empty) core into the inlet portions 11 before the growing roll is removed from the frame. The extent of automation of the improved apparatus can be selected practically at will, and the automatic control system can employ mechanical sensors, photocells, proximity detectors and/or other types of available monitoring and signal generating means to synchronize the movements of various mobile constituents of the apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for storing successive sheets of a stream of sheets, comprising means for transporting the sheets of the stream in a predetermined direction and along a predetermined path; guide means disposed at a level above said path and including an inlet portion and an outlet portion for a plurality of rotary cores which are insertable seriatim into the inlet portion of said guide means, said guide means having an elongated main portion extending in the general direction of transport of sheets along said path; means for rotating the core which is introduced into said guide means; and a support disposed below said path for at least one of a plurality of reels which are arranged to be separably mounted seriatim on said support and each of which includes a rotary hub and a supply of elongated band wound around the respective hub and including a leader connectable to the core which is introduced into the inlet portion of said guide means so that the band extends across said path and receives sheets from said transporting means when the core in said guide means is rotated in a direction to draw the band off the hub of the reel on said support and to convolute the band therearound with attendant confinement of sheets between the convolutions of the band on the core in said guide means and gradual increase of the diameter of the growing roll including a core in said guide means, the convolutions of the band on such core and the sheets between the convolutions of such band, the length of the main portion of said guide means at least matching the radius of a core plus the radius of a fully grown roll.

2. The apparatus of claim 1, wherein said guide means includes an elongated main portion extending in the general direction of transport of sheets along said path.

3. The apparatus of claim 2, wherein the length of the main portion of said guide means at least matches the radius of a core plus the radius of a fully grown roll.

4. The apparatus of claim 1, further comprising means for directing successive empty cores into the inlet portion of said guide means and means for facilitating removal of the cores of fully grown rolls from the outlet portion of said guide means.

5. The apparatus of claim 4, wherein said outlet portion is located downstream of said inlet portion, as considered in the direction of transport of sheets along said path.

6. The apparatus of claim 1, wherein said support includes means for moving the hub of a reel thereon between first and second positions spaced apart from one another by a distance at least matching the radius of a reel plus the radius of a hub.

7. The apparatus of claim 6, wherein the hub in said second position is located downstream of the hub in said first position, as considered in the direction of transport of sheets along said path.

8. The apparatus of claim 1, wherein the main portion of said guide means is at least substantially parallel to said path.

9. The apparatus of claim 1, further comprising an intercepting device disposed upstream of said guide means and means for moving said device to and from an operative position in which said device intercepts the oncoming sheets of the stream to thus establish in said path a gap between the non-intercepted preceding portion of the stream and the intercepted sheets so that the leader of the band of a fresh reel on said support can be advanced through such gap and across said path preparatory to coupling of such leader to a fresh core in said guide means.

10. The apparatus of claim 1, wherein each core has two end portions including stub shafts and said guide means defines a channel for the stub shafts of the core which is introduced into said guide means.

11. The apparatus of claim 1, wherein the inlet portion of said guide means extends toward said path.

12. The apparatus of claim 11, wherein the outlet portion of said guide means extends away from said path.

13. The apparatus of claim 12, wherein said inlet and outlet portions are inclined with reference to said path.

14. The apparatus of claim 13, wherein said rotating means includes motor means for said transporting means, said inlet portion being sufficiently close to said path so as to enable said transporting means to rotate a core which is introduced into the inlet portion of said guide means whereby the growing roll which develops when the leader of a band is coupled to such core moves in said inlet portion sideways and reaches the level of the main portion of said guide means.

15. The apparatus of claim 14, wherein said inlet and outlet portions make with said path angles of or close to 90 degrees.

16. The apparatus of claim 14, further comprising a ramp for directing successive empty cores into the inlet portion of said guide means, the distance between said ramp and said path at least matching the radius of a core.

17. The apparatus of claim 12, wherein said guide means defines a mouth arranged to receive the cores of fully grown rolls from said outlet portion, said mouth being configurated to facilitate removal of fully grown rolls from said guide means.

18. The apparatus of claim 1, further comprising means for advancing successive cores from the inlet portion, along the main portion and to the outlet portion of said guide means, said outlet portion extending away from said path so that the core of a growing roll can move in said outlet portion sideways in a direction away from said path.

19. The apparatus of claim 18, further comprising a frame for said guide means, said advancing means including at least one endless conveying element mounted on said frame and having entraining means arranged to advance an inserted core from the inlet portion to the outlet portion of said guide means.

20. The apparatus of claim 1, wherein said support is indexible through angles of substantially 180 degrees and includes first and second portions each arranged to removably support a hub, said first and second portions being arranged to switch positions in response to indexing of said support.

21. The apparatus of claim 20, wherein the distance between the axes of hubs on the first and second portions of said support at least matches the radius of a reel plus the radius of a hub.

22. The apparatus of claim 20, further comprising means for moving the leader of the band of a reel on at least one of said first and second portions across said path so that the leader of such band can be coupled to the core in the inlet portion of said guide means.

23. The apparatus of claim 22, wherein each core and the leader of each band respectively comprises complementary first and second coupling elements for releasably attaching the leader of a band forming part of a reel on one of said first and second portions to the core in the inlet portion of said guide means.

24. The apparatus of claim 22, wherein said moving means is mounted on said support.

25. The apparatus of claim 22, wherein said moving means includes discrete first and second moving devices, one for each portion of said support.

26. The apparatus of claim 1, wherein each band has a trailing portion provided with a first connecting element and each band further comprises a second connecting element disposed at the exterior of the outermost convolution of such band on the core of a fully grown roll and engageable by the first connecting element to thus releasably hold the trailing portion against movement with reference to such outermost convolution.

27. The apparatus of claim 26, wherein said connecting elements together constitute a Velcro (trademark) connection.

28. The apparatus of claim 1, further comprising a frame including a first section at one side and a second section at the other side of said guide means, and means for movably connecting said sections to each other.

29. Apparatus for storing successive sheets of a stream of sheets, comprising means for transporting the sheets of the stream in a predetermined direction and along a predetermined path; guide means disposed at a level above said path and including an inlet portion and an outlet portion for a plurality of rotary cores which are insertable seriatim into the inlet portion of said guide means; a frame including a first section at one side and a second section at the other side of said guide means, and means for movably connecting said sections to each other, one of said sections being movable to and from an operative position and said guide means having at least one elongated channel which is defined by said sections in the operative position of said one section; means for yieldably biasing said one section to said operative position; means for rotating the core which is introduced into said guide means; and a support disposed below said path for at least one of a plurality of reels which are arranged to be separably mounted seriatim on said support and each of which includes a rotary hub and a supply of elongated band wound around the respective hub and including a leader connectable to the core which is introduced into the inlet portion of said guide means so that the band extends across said path and receives sheets from said transporting means when the core in said guide means is rotated in a direction to draw the band off the hub of the reel on said support and to convolute the band therearound with attendant confinement of sheets between the convolutions of the band on the core in said guide means and gradual increase of the diameter of the growing roll including a core in said guide means, the convolutions of the band on such core and the sheets between the convolutions of such band.

30. The apparatus of claim 29, wherein said connecting means is adjacent to said inlet portion and defines for said one section a pivot axis extending substantially transversely of said path.

* * * * *